US005784882A

United States Patent [19]

Bonny et al.

[11] Patent Number: 5,784,882

[45] Date of Patent: Jul. 28, 1998

[54] EXHAUST MANIFOLD FOR CONDUCTING EXHAUST GAS OUT OF AN INTERNAL COMBUSTION ENGINE

[75] Inventors: Pierre Bonny, Hamburg; Thorsten Sternal, Moisburg, both of Germany

[73] Assignee: Daimler-Benz AG, Stuttgart, Germany

[21] Appl. No.: 891,737

[22] Filed: Jul. 14, 1997

[30] Foreign Application Priority Data

Jul. 17, 1996 [DE] Germany ..... 196 28 798.7

[51] Int. Cl.[6] ..... F01N 7/10

[52] U.S. Cl. ..... 60/323

[58] Field of Search ..... 60/321, 322, 323

[56] References Cited

U.S. PATENT DOCUMENTS

| | | | |
|---|---|---|---|
| 1,760,682 | 5/1930 | Boysen | 60/323 X |
| 2,230,666 | 2/1941 | Martin et al. | 60/323 |
| 5,572,868 | 11/1996 | Okamoto et al. | 60/323 |
| 5,682,741 | 11/1997 | Augustin et al. | 60/323 |

FOREIGN PATENT DOCUMENTS

| | | |
|---|---|---|
| 0 582 985 | 2/1994 | European Pat. Off. . |
| 42 22 104 | 1/1994 | Germany . |

*Primary Examiner*—Tony M. Argenbright
*Attorney, Agent, or Firm*—Klaus J. Bach

[57] ABSTRACT

An exhaust manifold for conducting exhaust gas from an internal combustion engine including a collection pipe structure having branches with engine flanges at their ends for mounting to cylinder outlet ports of the engine and an outlet flange at the downstream end of the pipe structure for connection to an exhaust pipe. The collection pipe structure has in the area of the branches a cross-section with different diameters for first and second cross-sectional directions which are normal to each other so as to form a drop-like or oval cross-sectional area which, in a downstream direction, continuously changes until the two diameters are equal providing for a circular shape at the end of the collection pipe structure adjacent the outlet flange.

8 Claims, 2 Drawing Sheets

EXHAUST MANIFOLD FOR CONDUCTING EXHAUST GAS OUT OF AN INTERNAL COMBUSTION ENGINE

BACKGROUND OF THE INVENTION

The invention relates to an exhaust manifold for conducting exhaust gas out of an internal combustion engine including a duct structure with flanges for connection to engine exhaust ports and a flange for connection to an exhaust pipe.

EP 0 582 985 A1 describes an exhaust manifold for conducting exhaust gas out of an internal combustion engine, which manifold consists of an inner manifold comprising a plurality of inner shells and an outer shell which surrounds the inner manifold at a distance and which is formed from shell parts connected to one another at their edges. The inner manifold is connected by means of inlet flanges to a plurality of cylinder outlet ports of the internal combustion engine which are arranged at a distance from one another and has an outlet flange by which it is connected to an exhaust pipe. With the exception of the area next to the inlet flanges and the area next to the outlet flange, the inner manifold and the outer shell are arranged at a distance from one another, thereby providing an interspace which can serve for air gap insulation or can be filled with an insulating material, so as to limit the transmission of heat from the wall of the inner manifold to the outer shell. The inner manifold and the outer shell consist of sheet metal, the outer shell having a greater wall thickness than the inner manifold.

In the known arrangement, the shape of the outer shell in h outlet region is designed in such a way that, in the flow direction of the exhaust gas, subsequent cross sections are approximately identical and have an approximately circular contour. The outer shell consists of two half-shells which are assembled together in their edge regions, the cross-section of the outer shell having the greatest accumulation of material in these regions. In this way, the outer shell has the highest bending strength for accommodating an external force load in the plane of the interconnected edge areas. For good air gap insulation, the outer shell is unsupported over wide regions. Consequently, it is quickly subject to material fatigue when differently directed forces are effective on the outer shell because of natural and resonant vibrations. This disadvantage of the known arrangement becomes apparent particularly with internal combustion engines which require long outlet regions for the exhaust manifold.

The object of the present invention is, therefore, to provide a manifold with a conduit structure which has a relatively long useful life that is a manifold which is relatively insensitive to the vibration stresses to which a manifold is normally subjected.

SUMMARY OF THE INVENTION

In an exhaust manifold for conducting exhaust gas from an internal combustion engine comprising a collection pipe structure having branches with engine flanges at their ends for mounting to cylinder outlet ports of the engine and an outlet flange at the downstream end of the pipe structure for connection to an exhaust pipe, the collection pipe structure has in the area of the branches a cross-section with different diameters for first and second cross-sectional directions which are normal to each other so as to form a drop-like or oval cross-sectional area which, in a downstream direction, continuously changes until the two diameters are equal providing for a circular shape at the end of the collection pipe structure adjacent the outlet flange.

According to a preferred embodiment of the invention, the pipe structure is formed from an inner pipe and an outer shell which surrounds the latter and provides the mechanical support strength for the exhaust manifold, the outer shell being composed of at least two shell parts. The shell parts are connected to one another at their edges and enclose the inner pipe with its ends mounted in the flange, and a space for air gap insulation being formed between the inner pipe and the outer shell. In such an arrangement, the heat insulation behavior of the exhaust manifold is improved.

The cross-section of the outer shell in the outlet region is extended in the plane of any bending torque applied by external forces on the exhaust manifold, with the result that it can generate a high moment of resistance to counteract the force load. Starting from the largest diameter of the outer shell, the cross-section changes as the diameter decreases continuously in the flow direction of the exhaust manifold and finally reaches its minimum that is a circular cross-section in an outlet area adjacent to the outlet flange. In the outlet area, the outer shell remains circular up to its end which is connected to the outlet flange. The continuous reduction in the diameter is limited such that the formation of stress peaks in the outer shell material as a consequence of excessive changes in cross-section is avoided.

The contour of the cross-section of the outer shell is preferably designed symmetrically relative to a cross-sectional axis corresponding to its shorter diameter or, in addition, relative to a cross-sectional axis corresponding to its longer diameter. The manufacturing of the shell is then relatively simple and furthermore, bending stresses resulting from external loads are distributed uniformly over the cross-section.

Preferably, the outer shell consists of two half-shell parts, the edges of the half-shell parts being bent outwards and crimped so as to be connected to one another. If the connecting surfaces of the half-shell edges are disposed in the cross-sectional axial plane corresponding to the shorter diameter, they increase the bending strength of the outer shell in the direction in this plane due to the accumulation of material in their edge regions as a result of the crimping.

In a particularly preferred embodiment, an inner pipe carrying exhaust gas, which has a preferably circular cross-section, is arranged concentrically to the point of intersection of the cross-sectional axes of the outer shell. A space for air gap insulation is formed between the inner pipe and the outer shell, the space being widened in the direction of the larger outer shell diameter according to the extent of the cross-section of the outer shell. Because of the enlarged air gap, heat radiation from the inner pipe to the more remote outer shell area and consequently, the emission of heat from the outer shell to the ambient area adjacent thereto are reduced.

Preferably, the inner pipe consists of a plurality of preformed inner pipe sections, each inner-pipe section being assigned to an outlet port of the engine and having an engine flange for connection to a cylinder outlet port, and a preformed inner pipe section in the outlet region the exhaust manifold with an outlet flange for connection to an exhaust gas conduit. Such an inner pipe consisting of a plurality of preformed sections can be produced and assembled cost effectively in a simple manner. It also has a high strength for accommodating loads resulting form thermal stresses.

An exemplary embodiment of the invention is described in greater detail below with reference to the accompanying drawings:

DESCRIPTION OF A PREFERRED EMBODIMENT

Figure 1:
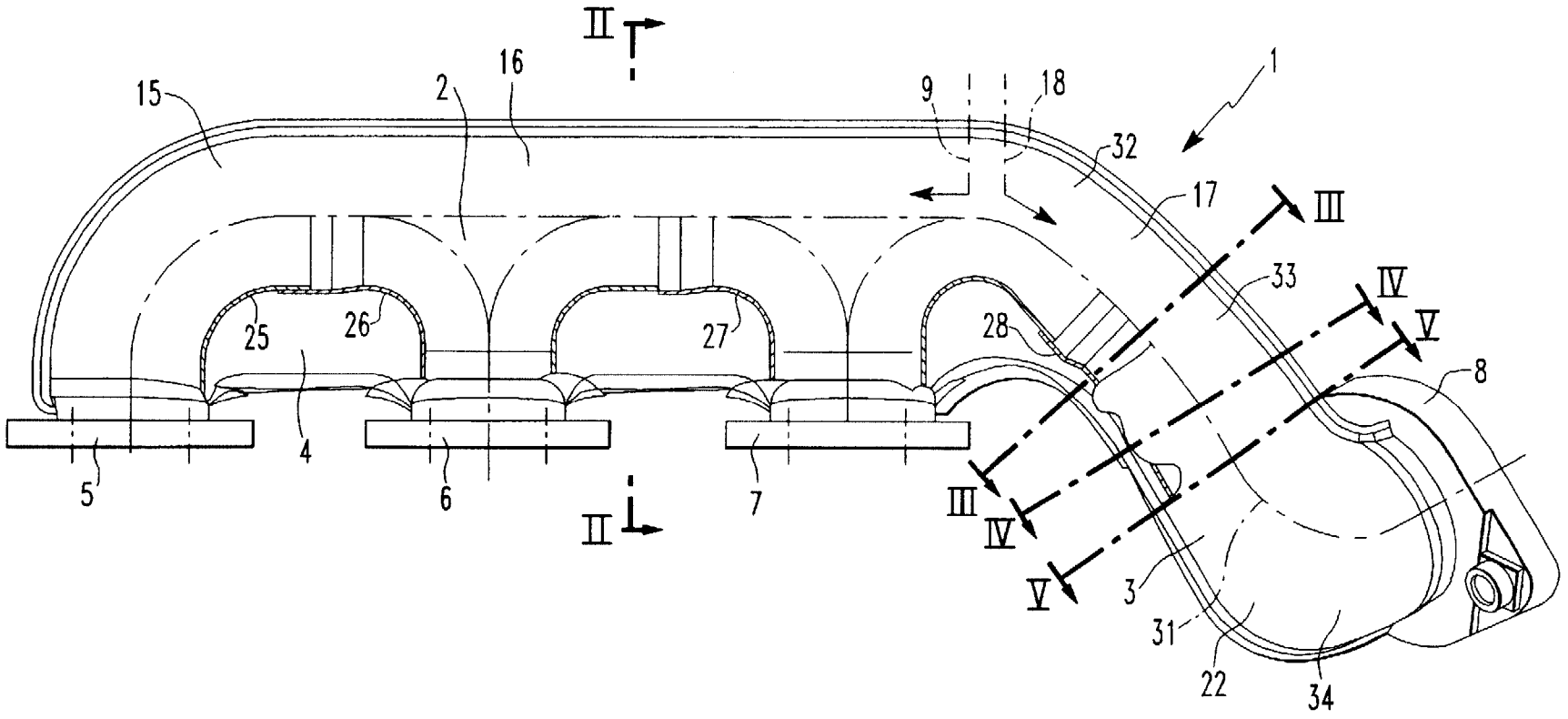
FIG. 1 is a partially sectional top view of a double-walled exhaust manifold with an extended outlet region.

FIG. 1 is a top view of a double-walled exhaust manifold 1 for conducting exhaust gas out of an internal combustion engine. The manifold consists essentially of an inner pipe 2 carrying exhaust gas, an outer shell 3, a plurality of engine flanges 5, 6, 7 disposed in a common plane for the connection of the inner pipe to cylinder outlet ports and an outlet flange 8 for connecting the inner pipe to an exhaust pipe or other devices handling exhaust gas. The inner pipe 2 comprises a plurality of pre-formed sections 25, 26, 27, 28, namely a bent section 24 connected to the engine flange 5, a T-piece 26 connected to the engine flange 6, a T-piece 27 connected to the engine flange 7 and having a curved leg adjacent the pipe section which follows in the direction of flow, and an elbow piece 28 which is connected to the outlet flange 8. The elbow piece 28 is angled in the viewing direction, but extends essentially in a straight line in its projection as shown in FIG. 1. It is angled arcuately at its end adjacent to the outlet flange 8 as can be seen in FIG. 1. The pipe sections are inserted one into the other with slight play in a socket-like fashion. The downstream sections in each case have widened end portions which receive the end portions of the upstream pipe sections.

The inner pipe 2 is arranged, within the outer shell 3, centered at the point of intersection of the largest diameter line of the outer shell and the largest diameter line which is normal thereto, forming a closed-off space 4 for air gap insulation between the inner pipe 2 and the outer shell 3. The outer shell 3 consists of a plurality of shell parts, the ends of which may be welded into the openings of the flanges 5, 6, 7, 8 or they may be welded directly onto the inner pipe 2 in front of the flanges.

The exhaust manifold 1 comprises an inlet region 9 extending from the engine flanges 5, 6, 7 to a cross-sectional plane disposed downstream of the last engine flange 7 approximately level with the curved portion of the inner pipe section 17. In this region the outer shell 3 has, in accordance with the configuration of the inner pipe 2, a section 15 and a center section 16 extending essentially in a straight line. The outer shell is streched in the direction toward the engine flanges up to a plane adjacent to the engine flanges. The arrangement provides for a cross-section, as shown in greater detail in FIG. 2, taken along the line II—II of the exhaust manifold 1.

In an outlet region 18 which follows the inlet region 9 in downstream direction and is in the curved portion of the inner pipe section 27, the shape of a connection part 17 of the outer shell 3 is designed to correspond to the profile of the inner pipe 2. In the outlet region 18, the exhaust manifold 1 extends in the direction of an exhaust pipe center line 31 as shown in FIG. 1, in a first bent portion 32, a second portion 33 which corresponds to the shape of the enclosed pipe section 28 and is angled in the viewing direction but appears straight as a projection in the viewing plane and a third end portion 34 bent by about 90° with respect to the direction of the bending direction of the second portion. In the first portion 32 of the outlet region 18, the distance between the edges of the outer shell 3 and therefore the diameter of the latter in one direction are reduced by providing suitable radii of curvature for the outer shell 3. At the same time, the diameter of the outer shell 3 in an approximately orthogonal direction of the diameter normal thereto is increased, with the result that the outer shell 3 has markedly different orthogonal diameters in the second portion 33 of the outlet region. In this way, as described with reference to the FIG. 3, the bending strength of the outer shell 3, which is a load bearing component of the exhaust manifold 1, is increased. Furthermore, improved shielding of the outer shell 3 against the heat of the inner pipe 2 carrying the exhaust gas is achieved by the enlargement of the interspace 4.

In the second portion 33 of the outlet region 18, the larger diameter of the outer shell 3 is reduced continuously in a downstream direction. At the same time, the rate at which the cross-section is reduced however is so small that no harmful stress peaks occur in the material of the outer shell 3 when the exhaust manifold 1 is subjected to mechanical load by external forces. Finally, the diameter of the outer shell is reduced to a contour of the outer shell 3 corresponding to an outlet end cross-section which remains unchanged over the length of the third bent end portion 34 of the outlet region 19.

Figure 2:
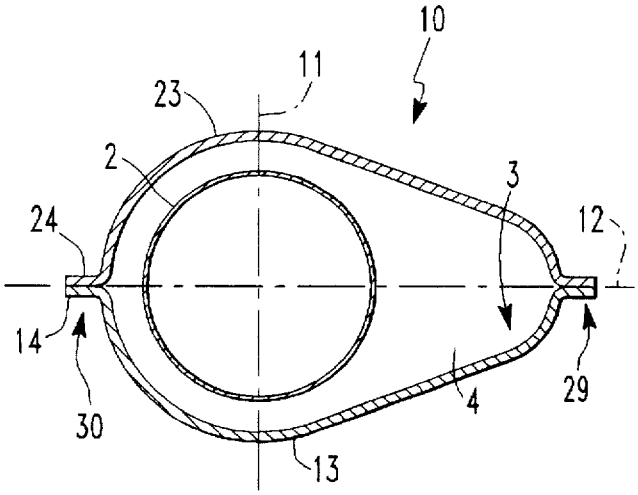
FIG. 2 is a cross-sectional view taken along the line II—II of FIG. 1.

FIG. 2 shows a section taken along line II—II in FIG. 1, illustrating an inlet cross-section 10 in the inlet region of the exhaust manifold. The outer shell 3 consists of a lower half-shell 13 and an upper half-shell 23 which have outwardly bent edges 14 and 24, at which the half-shells 13 and 23 are in mirror symmetric engagement with one another at the end regions 29 and 39. The mirror axis is a second cross-sectional axis 12 which extends through the end regions 29 and 30, that is, a transverse diameter of the outer shell 3 which extends orthogonally to a first cross-sectional axis 11 corresponding to the vertical diameter of the outer shell 3. The inner pipe 2 is arranged in the outer shell 3 concentrically to the point of intersection of the second cross-sectional axis 12 and the first cross-sectional axis 11. The cross-section 10 of the outer pipe has essentially the shape of a drop, such that the end region 29 adjacent to the inlet flanges, which are not illustrated here for the sake of clarity, is at a greater distance from the first cross-sectional axis 11 than the edge region 30. The air gap insulation space 4 formed between the outer shell 3 and the inner pipe is thereby enlarged in the region adjacent to a plane extending through the inlet flanges, with the result that an optimum heat insulation behavior of the exhaust manifold is achieved and, furthermore, an increases in the useful life is to be expected because of a greater design strength of the exhaust manifold.

Figure 3:
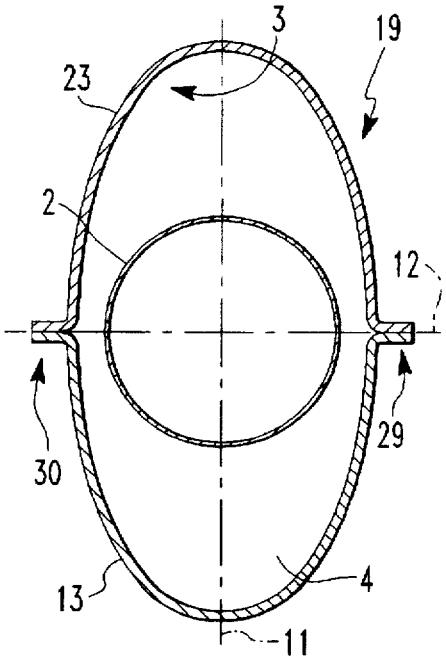
FIG. 3 is a cross-sectional view taken along the line III—III of FIG. 1.

The section along line III—III in FIG. 1, shown in FIG. 3, illustrates a manifold cross-section 19 in the outlet region, wherein the outer shell 3 has an elliptical shape. Here, the larger diameter of the ellipse is assigned to the first cross-sectional axis 11 and the smaller ellipse diameter is assigned to the second cross-sectional axis 12 passing through the shell edge regions 29, 30. The outer shell 3 surrounds the inner pipe 2 of circular cross-section concentrically, with the result that the space 4 for air gap insulation, formed between the outer shell 3 and the inner pipe 2, is extended in the direction of the first cross-sectional axis 11, the space thereby being enlarged.

Due to the increased diameter of the first cross-sectional axis 11, the cross-section of the outer shell 3 has an increased polar moment of inertia or moment of resistance with respect to the transverse axis 12 of the manifold, with the result that the outer shell 3, in its function as a load-bearing component of the exhaust manifold, has an increased bending strength for opposing an external force acting on it, the increase in bending strength corresponding to the increase in the polar moment of inertia. The polar moment of inertia of the elliptical cross-section is increased in the transverse direction, that is, with respect to the first cross-sectional axis 11, by the accumulation of material in the end regions 29 and 30, with the result that the outlet region of the manifold has sufficient bending strength to withstand changes in the direction external forces acting on it.

Figure 4:
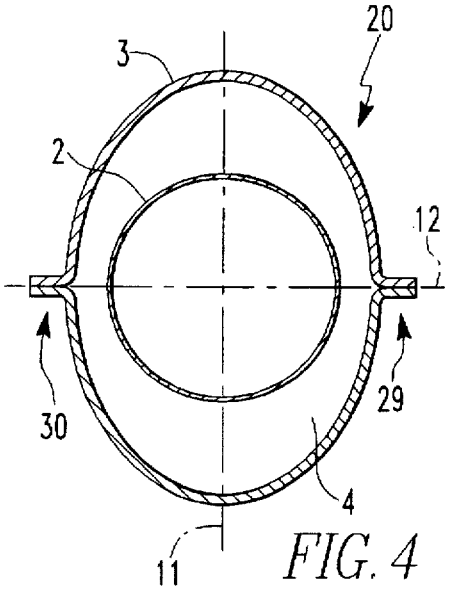
FIG. 4 is a cross-sectional view taken along the line IV—IV of FIG. 1.

The intermediate cross-section 20 according to section IV—IV of FIG. 1, as shown in FIG. 4, has an elliptically designed outer shell 3, the eccentricity of the ellipse being smaller than in FIG. 3 since the diameter of the outer shell 3 in the direction of the first cross-sectional axis 11 has been decreased. With the distance between the end regions 29 and 30 being the same as in the cross-section according to FIG. 3, the continuous load-matched reduction in th eccentricity of the elliptic cross-section 20 insures that the material stress in the outer shell resulting from external forces acting on it is distributed uniformly over the entire cross-section.

Figure 5:
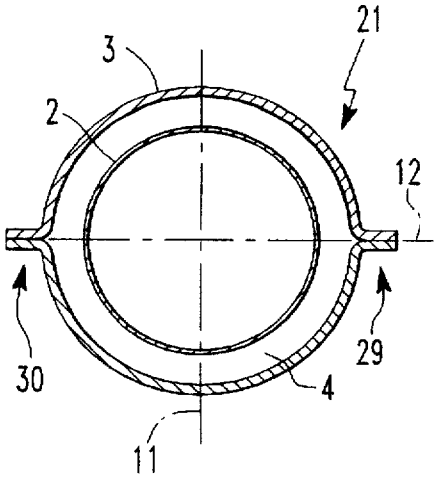
FIG. 5 is a cross-sectional view taken along the line V—V of FIG. 1.

FIG. 5 shows, in a section taken along line V—V of FIG. 1, an outlet cross-section 21 for a circular outer shell 3. Here, the diameter of the outer shell corresponds to the distance between the edge regions 29 and 30, the distance being constant over the entire outlet region. This outlet cross-section 21, with a circular outer shell 3, a concentrically arranged inner pipe 2 and an annular air gap insulation space 4 is unchanged over the whole end region of the exhaust manifold up to the connection to the outlet flange 8.

Alternatively to the elliptical shape, the outer shell of the exhaust manifold may have other extended cross-sectional shapes, such as a largely rectangular box shape.

In exemplary embodiments described above, the invention is explained with regard to exhaust manifolds having air gap insulation. However, the advantageous embodiment may also be used for exhaust manifolds consisting only of a single pipe, that is to say a pipe without an outer shell in order to increase its moment of resistance.

What is claimed is:

1. An exhaust manifold for conducting exhaust gas from an internal combustion engine, said exhaust manifold comprising a collection pipe structure having branches with engine flanges at their ends for connection to spaced cylinder outlet ports of said engine and an outlet flange at the downstream end of said collection pipe structure for connection to an exhaust pipe, said collection pipe structure having an outlet region with a cross-sectional area having substantially different diameters in first and second directions which extend normal to each other so as to define an oval or drop-like cross-sectional area, which in a downstream direction changes continuously up to an end section of said outlet region where said normally extending diameters are equal and said collection pipe structure has a circular cross-section.

2. An exhaust manifold according to claim 1, wherein said collection pipe structure includes an inner pipe and an outer shell surrounding said inner pipe and providing mechanical support for said exhaust manifold, said outer shell being composed of at least two shell parts having axially extending edges connected to one another so as to enclose said inner pipe, said inner pipe having said flanges attached thereto and said outer shell surrounding said inner pipe in spaced relationship so as to form an air gap insulation space between said inner pipe and said outer shell.

3. An exhaust manifold according to claim 1, wherein said larger diameter of said collection pipe structure on the first cross-sectional axis is reduced in the direction of flow, and the diameter on the second cross-sectional axis is essentially unchanged in the direction of flow.

4. An exhaust manifold according to claim 1, wherein said pipe structure is designed symmetrically with respect to at least one of the cross-sectional axes.

5. An exhaust manifold according to claim 2, wherein said outer shell is formed from a lower half-shell and an upper half-shell having edges which are bent outwardly and connected to one another at their outwardly extending surfaces.

6. An exhaust manifold according to claim 2, wherein said inner pipe is arranged centrally on the point of intersection of said first and second sectional axes and within said outer shell.

7. An exhaust manifold according to claim 2, wherein said inner pipe consists of a plurality of inner pipe sections each having an engine flange, adjacent inner pipe pieces being inserted one into the other to form a socket connection.

8. An exhaust manifold according to claim 1, wherein said manifold has an outlet region and an inlet region and said outlet region is substantially longer than the sections between said engine flanges of said inlet region.

* * * * *